US005247130A

United States Patent [19]

Suzuki et al.

[11] Patent Number: 5,247,130

[45] Date of Patent: Sep. 21, 1993

[54] TONE SIGNAL PROCESSING APPARATUS EMPLOYING A DIGITAL FILTER HAVING IMPROVED SIGNAL DELAY LOOP

[75] Inventors: Hideo Suzuki; Kazuhisa Okamura, both of Hamamatsu, Japan

[73] Assignee: Yamaha Corporation, Hamamatsu, Japan

[21] Appl. No.: 734,279

[22] Filed: Jul. 22, 1991

[30] Foreign Application Priority Data

Jul. 24, 1990 [JP] Japan ..... 2-194019

[51] Int. Cl.[5] ..... G10H 1/12

[52] U.S. Cl. ..... 84/622; 84/607; 84/661; 84/DIG. 9

[58] Field of Search ..... 84/600-603, 84/607, 608, 622, 623, 626, 630, 647, 661, 662, DIG. 9, DIG. 10

[56] References Cited

U.S. PATENT DOCUMENTS

| | | | |
|---|---|---|---|
| 4,548,119 | 10/1985 | Wachi et al. | 84/DIG. 9 X |
| 4,554,858 | 11/1985 | Wachi et al. | 84/DIG. 9 X |
| 4,829,463 | 5/1989 | Kakishita et al. | 84/DIG. 9 X |
| 4,841,828 | 6/1989 | Suzuki | 84/DIG. 9 X |
| 4,907,484 | 3/1990 | Suzuki | 84/661 |
| 5,050,474 | 9/1991 | Ogawa et al. | 84/603 |
| 5,149,902 | 9/1992 | Washiyama | 84/622 |

*Primary Examiner*—William M. Shoop, Jr.
*Assistant Examiner*—Jeffrey W. Donels
*Attorney, Agent, or Firm*—Graham & James

[57] ABSTRACT

A series of delay circuits are provided which receive tone signal sample data of plural channels supplied on a time shared basis, hold plural tone signal sample data of each channel and hold these plural sample data while sequentially delaying them. The series of delay circuits are connected in an endless manner to form a circulating loop and plural data selection circuits are provided at predetermined delay stages. Each data selection circuit performs a selection control as to whether new tone signal sample data should be loaded in the delay circuit loop or data in the delay circuit should be circulated. Tone signal sample data which are provided sequentially from the delay circuit loop after delay are sequentially operated with filter coefficients of plural orders and results of the operation are accumulated to obtain a filter operation output. This construction enables tone signal sample data of a necessary channel to be loaded in the delay circuit loop at a point of a necessary data selection circuit in a time period which is shorter than one cycle of the entire delay circuit loop. Therefore, the time division period of supplied tone signal sample data of each channel can be made different from the time division period of each channel in the delay circuit loop.

8 Claims, 6 Drawing Sheets

TONE SIGNAL PROCESSING APPARATUS EMPLOYING A DIGITAL FILTER HAVING IMPROVED SIGNAL DELAY LOOP

BACKGROUND OF THE INVENTION

This invention relates to a tone signal processing device performing controls such as a tone color control of a tone or a waveform interpolation operation by utilizing a digital filter operation.

As a tone signal processing device using a digital filter, there are prior art devices disclosed in Japanese Preliminary Patent Publication No. 62-127899 corresponding to U.S. Pat. No. 4,841,828 and other publications. In these devices, plural tone signal sample data are sequentially delayed in a delay register having multiple delay stages which correspond to filter coefficient orders in one-to-one relationship and filter coefficients corresponding to respective orders are supplied in response to the delayed outputs on a time shared basis to perform a filter operation. It is also disclosed that a filter operation is performed for tone signals of plural channels on a time shared basis. In these devices, however, a filter operation circuit of one channel cannot be used for all channels on a time shared basis, and consequently there are provided filter operation circuits of plural channels.

In these prior art devices, operation must be made with respect to all filter orders with the result that the amount of operation and the number of delay stages become enormous. For overcoming this problem, Japanese Preliminary Patent Publication No. 63-168695 corresponding to U.S. Pat. Ser. No. 07/139,659 proposes a simplified filter operation resembling interpolation. According to the proposed filter operation, a filter operation of m orders is made with respect to tone signal sample data of n samples ($n<m$). More specifically, while tone signal sample data is sequentially generated in correspondence to an integer section of an address signal, n filter coefficients are selected from among filter coefficients of m orders in correspondence to the value of a decimal section of the address signal (the combination of orders of the selected filter coefficients differs depending upon the value of the decimal section of the address signal) and then, by operating tone signal sample data of n samples with the selected n filter coefficients, a filter operation of m orders is substantially performed. It is also disclosed that a filter operation is made with respect to tone signals of plural channels. In this case, a filter operation circuit employs a hardware circuit which is common to all channels and filter coefficient multiplication for n orders is made for each channel on a time shared basis. In this device, however, a delay circuit is not provided for providing tone signal sample data of n samples; instead, in performing the filter coefficient multiplication for n orders, tone signal sample data for n samples are read on a time shared basis from a waveform memory at a multiplication timing of each order.

In this Japanese Preliminary Patent Publication No. 63-168695, it is disclosed that, as tone signal sample data of n samples, data of n addresses stored in a waveform memory, rather than generated data of fixed n sampling periods, is used. This signifies that a simple filter operation according to a constant sampling period is not made but the sampling period of the filter operation changes with the tone pitch of a tone and thereby a waveform interpolation operation over n samples is made and data of one sample is formed as a result of this interpolation operation.

In a case where a filter operation is to be made with respect to tone signals of plural channels, it is readily conceivable to employ a common filter operation circuit for plural channels on a time shared basis. In such a case, however, because coefficient operation for each order for one channel is made on a time shared basis by using a common operation circuit, the number of time division slots will become extremely large when the number of filter orders is large (the time division slot number equal to the number of orders multiplied by the number of channels is required), as long as the operation is made in a normal manner. Therefore, a time division operation at an extremely high rate is required for maintaining a necessary sampling frequency. For this reason, the above mentioned Japanese Preliminary Patent Publication No. 62-127899 (U.S. Pat. No. 4,841,828) provides filter operation circuits of plural channels.

In the above mentioned Japanese Preliminary Patent Publication No. 63-168695, such an arrangement is provided as to carry out a filter operation of m orders through operation of n coefficients which are much fewer in number than m and, accordingly, the number of operation time slots for one channel is reduced and the employment of a common filter operation circuit for plural channels on a time shared basis can be made easily. In this prior patent application, however, supply of tone signal data of n samples is made not by provision of a delay circuit but by reading out tone signal sample data of n samples from a waveform memory on a time shared basis at a multiplication timing of each order, and this resultantly poses the problem that the time division operation timing for each order is undesirably limited by the access speed of the waveform memory. Besides, since relation between the channel time division timing and time division multiplication timing of coefficient of each order is relatively simple (i.e., time slots for one channel are divided further by the number of time division time slots of coefficient of each order), there arises the inconvenience that, as in the prior art devices, a time division operation at an extremely high rate is required for maintaining necessary sampling frequency when the number of orders is large.

SUMMARY OF THE INVENTION

It is, therefore, an object of the invention to provide a tone signal processing device capable of applying a filter operation to tone signal sample data of plural channels on a time shared basis without imposing much burden on circuitry, that is, without requiring a time division operation at an extremely high rate.

It is another object of the invention to provide a tone signal processing device which, in a case where a tone signal of a smooth waveform is to be generated by performing a waveform interpolation operation using a digital filter operation, is capable of applying a waveform interpolation operation processing to tone signal sample data of plural channels on a time shared basis without imposing much burden on circuitry, that is, without requiring a time division operation at an extremely high rate.

A tone signal processing device according to the invention comprises a tone signal generation circuit for generating tone signal sample data of plural channels on a time shared basis, a circulating register circuit for holding plural tone signal sample data for each of said channels, said circulating register circuit including a series of delay circuits for holding respective sample data while delaying the data sequentially, said series of delay circuits being connected in an endless manner to form a circulating loop and having plural data selection circuits at predetermined delay stages, and each of said data selection circuits performing a selection control as to whether new tone signal sample data should be provided from said tone signal generation circuit to said delay circuit loop or data of said delay circuit loop should be circulated, a filter coefficient supply circuit for supplying filter coefficients of plural orders, and an operation circuit for operating tone signal sample data which has been sequentially provided from said circulating register circuit after delay with said filter coefficients and thereby obtaining a filter operation output.

If loading of new tone signal sample data in the circulating register circuit is made at a constant sampling period, a normal digital filter operation is realized, whereas, if such loading of data is made when the value of the tone signal sample data changes, a waveform interpolation operation using a digital filter operation is realized.

In the present invention, there is a feature in the construction of the circulating register circuit. The circulating register holds plural tone signal sample data for each channel and has a series of dealy circuits which hold respective sample data while sequentially delaying the data. These delay circuits are connected in an endless manner to form a circulating loop and plural data selection circuits are incorporated at predetermined delay stages. Each data selection circuit performs a selection control as to whether new tone signal sample data should be loaded from the tone signal generation circuit to the delay circuit loop or data in the delay circuit loop should be circulated.

By providing plural data selection circuits at each predetermined delay stage in the delay circuit loop which circulatingly holds plural tone signal sample data of plural channels while delaying the data sequentially, new tone signal sample data can be loaded at plural points in the delay circuit loop whereby tone signal sample data of a necessary channel can be loaded in the delay circuit loop at a time period which is shorter than one circulating period of the entire delay circuit loop and at a point of a necessary data selection circuit. In other words, the invention comprises an entirely novel construction in that although a time division serial structure is adopted as a whole, a structure which seemingly resembles a parallel conversion structure is adopted in the part of the plural data selection circuits and this structure is provided through the series of delay circuit loop, so that a time division serial structure is maintained as a whole.

By this construction, the time division period of tone signal sample data of each channel provided by the tone signal generation circuit can be made different from the time division period of each channel in the delay circuit loop, whereby a proper circuit design which does not require a time division operation at an excessively high rate can be adopted so that a construction in which excessive burden is not imposed on the circuit can be realized.

Assume, for example, that the filter operation is made by using eight operation time slots 0–7 for one channel and through eight channels (CH0–CH7) on a time shared basis. The number of delay stages of the delay circuit loop in this case is $8\times8=64$ and the state of the time division time slots becomes as shown in part (a) of FIG. 1 in which $8\times8=64$ time slots circulate. Assume again that the number of the data selection circuits provided in the delay circuit loop is 4 and that sample data of one channel is respectively loaded in each data selection circuit while 8 time slot data for one channel completes one cycle. In this case, data of 4 channels in all can be loaded and this signifies that it will suffice if the time division time slot of tone signal sample data for the respective channels CHO–CH7 provided by the tone signal generation circuit assumes a state as shown in part (b) of FIG. 1. As will be apparent from comparison of parts (a) and (b) of FIG. 1, the time division period of tone signal sample data for each channel can be made different from the time division period of each channel in the delay circuit loop. As a result, while a relatively high rate may be used as the time division period of tone signal sample data of each channel provided by the tone signal generation circuit to secure a necessary sampling period and thereby improve waveform resolution, a relatively low rate may be used as the time division period of each channel in the delay circuit loop to give an ample allowance to the filter operation time slot and thereby obviate requirement for an excessively high rate in the time division filter operation.

In contrast thereto, in the prior art device in which the relation between the channel time division timing and the time division multiplication timing of coefficient of each order is simple (i.e., the time slot for one channel is further divided by the number of the time division time slot of coefficient of each order), the time division time slot of tone signal sample data of each channel supplied to the filter corresponds directly to the time division time slot of each channel in the filter as the time slots CHO–CH7 of part (a) of FIG. 1. In the prior art device, therefore, when a relatively short time division period is used for securing a necessary sampling frequency, the filter operation time division time slot resulting from further dividing this short time division period has to be of a considerably high rate. The present invention has overcome this problem.

As will be apparent from the foregoing, according to the invention, a time division filter operation of an excessively high rate is not required and, accordingly, a time division filter operation processing for plural channels becomes easier to carry out even when the number of the filter orders is large. The present invention therefore is applicable to an ordinary type of filter operation in which operations for coefficients of all necessary orders are actually carried out.

The invention is applicable not only to an ordinary type of filter operation but also to a filter operation of a type in which operation is performed with respect to coefficients of n which are fewer than the order number m. In this case, the tone signal generation circuit comprises a circuit for generating an address signal consisting of an integer section and a decimal section which change at a rate corresponding to tone pitch of a tone to be generated and a circuit for generating tone signal sample data for each channel on a time shared basis in response to the integer section of an address signal of each channel. The filter coefficient supply circuit supplies the filter coefficient of plural orders in response to value of the decimal section of the address signal. Description will be made later about an embodiment in which the invention is applied to a type of filter operation according to which a filter operation of an order number m is substantially made by such omitted coefficient operation and such omitted form of filter operation is used for waveform interpolation.

The above described circulating register circuit may be replaced by a readable and writable memory circuit such as a random-access memory (RAM). That is, in another aspect of the invention, the tone signal processing device comprising a tone signal generation circuit for generating tone signal sample data of plural channels in a first channel time division period on a time shared basis, a read/write memory circuit for storing plural tone signal sample data of each channel, a writing circuit for writing tone signal sample data of each channel generated by said tone signal generation circuit in said memory circuit, a reading circuit for sequentially reading out plural tone signal sample data of each channel stored in said memory circuit in a second channel time division period which is independent from said first channel time division period, a filter coefficient supply circuit for supplying filter coefficients of plural orders, and an operation circuit for operating tone signal sample data which has been sequentially read from said memory circuit with said filter coefficients and thereby obtaining a filter operation output. In short, purposes similar to the above-mentioned can be achieved by setting different or independent channel time division periods for reading from and writing into the memory circuit.

Preferred embodiments of the invention will be described below with reference to the accompanying drawings.

BRIEF DESCRIPTION OF THE DRAWINGS

In the accompanying drawings.

DESCRIPTION OF PREFERRED EMBODIMENTS

Figure 1:
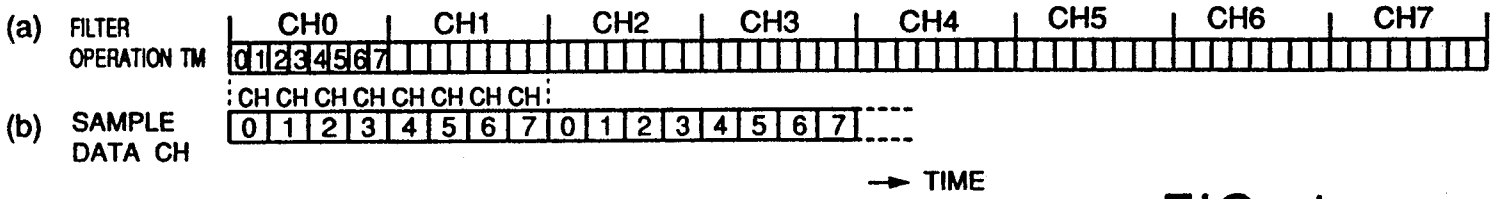
FIG. 1 is a time chart showing that the time division period of tone signal sample data of each channel and the time division period of filter operation are different from each other according to the invention.
Figure 2:
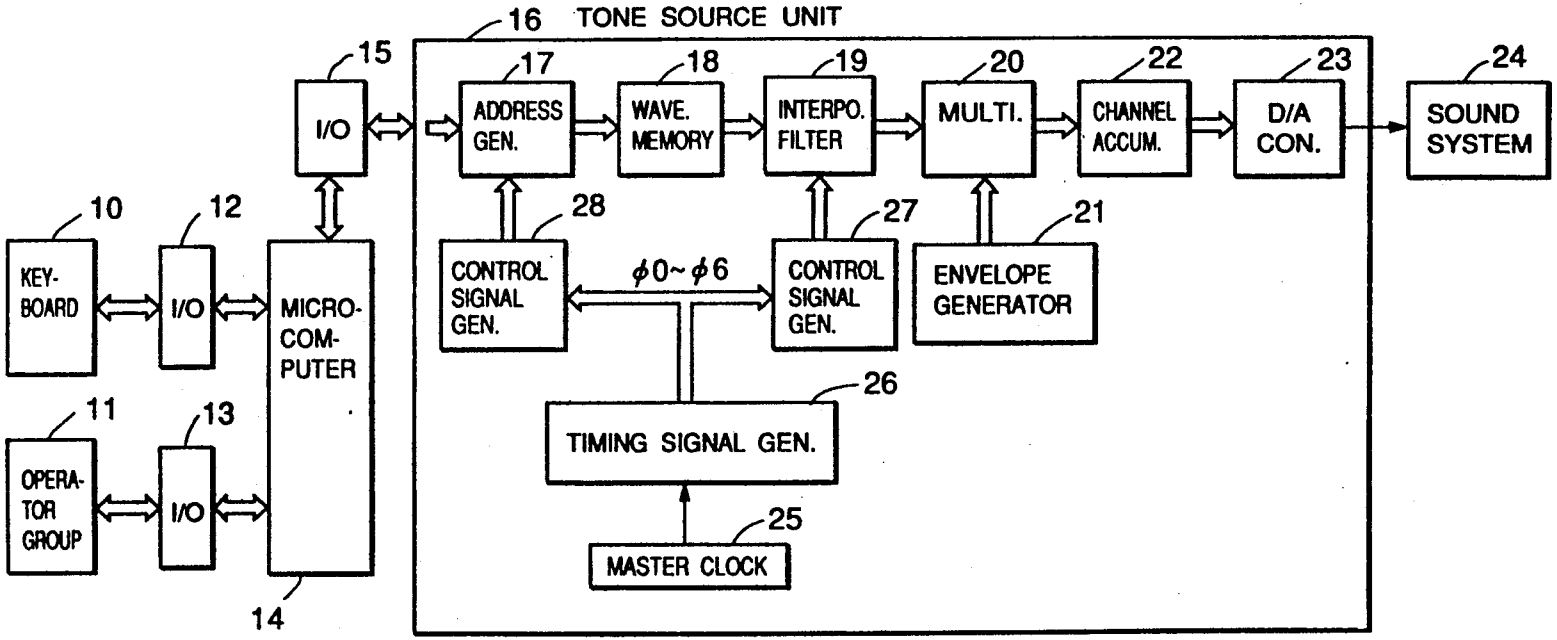
FIG. 2 is a block diagram showing an example of entire construction of an electronic musical instrument incorporating the invention.

FIG. 2 is a block diagram showing an example of an entire construction of an electronic musical instrument incorporating the invention. A keyboard 10 includes plural keys for designating tone pitches of tones to be generated. An operator group 11 is a group of operators and switches for selecting or establishing tone color, tone volume, effect etc. The keyboard 10 and operator group 11 are connected to a microcomputer 14 through I/O interfaces 12 and 13 so that on-off states of respective keys and operation states of respective operators are scanned. The microcomputer 14 suitably processes results of scanning and delivers various data to a tone source unit 16 through an I/O interface 15. The tone source unit 16 can form tone signals in plural channels (e.g., 8 channels) on a time shared basis. The microcomputer 14 performs a key assigning operation for respective channels and gives information of depressed keys which have been assigned to respective channels and other information to the tone source unit 16 through the I/O interface 15.

In the tone source unit 16, portions including an address generator 17 and a waveform memory 18 constitute tone signal generation means for generating tone signal sample data of plural channels on a time shared basis. The waveform memory 18 stores a plurality of tone waveform sample data corresponding to various tone colors. Based on information of a depressed key assigned to each channel and other information supplied through the I/O interface 15, the address generator 17 generates an address signal for reading out a tone waveform corresponding to a selected tone color at a pitch corresponding to the tone pitch of the depressed key.

An interpolation filter 19 applies a filter operation to tone waveform sample data of each channel which has been generated on a time shared basis from the waveform memory 18 and thereby performs a waveform interpolation operation using a filter operation. The interpolation filter 19 substantially performs a filter operation of m orders by using n coefficients which are fewer than the entire order number m (i.e., performing an interpolation filter operation). For example, m is 128 and n is 8.

A multiplier 20 imparts a tone volume envelope to a tone signal of each channel provided by the interpolation filter 19. An envelope generator 21, as is well known, generates an envelope shape signal in accordance with depression and release of a key assigned to each channel, thereby enabling the multiplier 20 to impart a tone volume envelope.

A channel accumulator 22 totals tone signal data of one sample point for each channel provided by the multiplier 20 and then releases the channel time division state. The output of the accumulator 22 is converted to an analog signal by a digital-to-analog converter 23 and thereafter is supplied to a sound system 24.

The tone source unit 16 includes, besides the above described circuits, a master clock oscillator 25, a timing signal generator 26 which produces different clock pulses $\phi 0$–$\phi 6$ by frequency-dividing this master clock, control signal generators 27 and 28 which produce various control signals on the basis of these clock pulses $\phi 0$–$\phi 6$, an unillustrated effect imparting circuit and other circuits.

Figure 3:
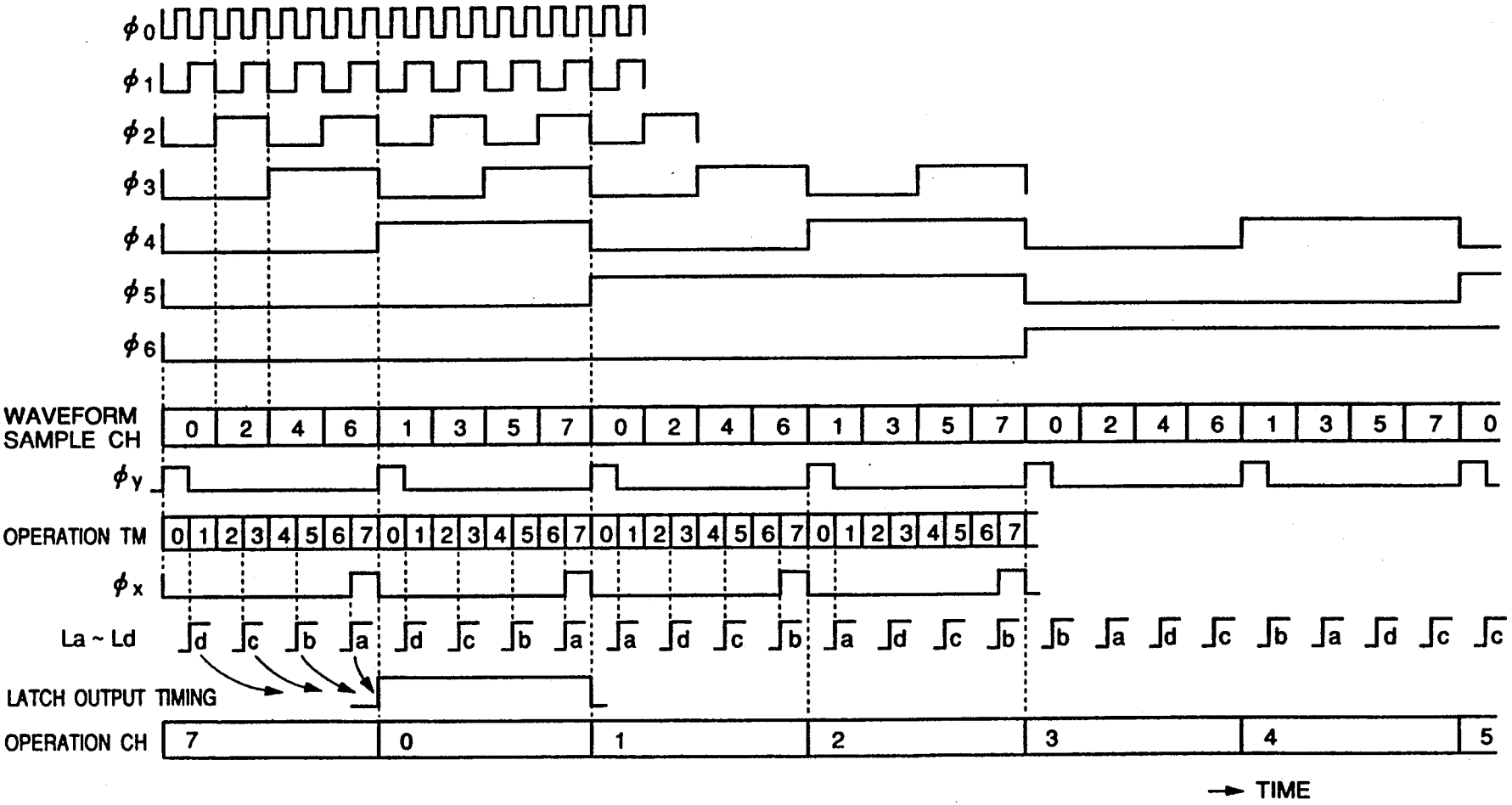
FIG. 3 is a time chart showing an example of timing relation between various clock pulses and input and output signals in respective circuits.

An example of states of these clock pulses $\phi 0$–$\phi 6$ and input and output signal timings in the respective circuits is shown in FIG. 3.

An example of the address generator 17 will be described with reference to FIG. 4. In the figure, reference characters such as "8D" and "2D" indicated in blocks denote delay circuits and these reference characters designate a delay stage. These delay circuits may be constructed of shift registers which are delay controlled (i.e., shift controlled) by clock pulses indicated with arrows.

Figure 4:
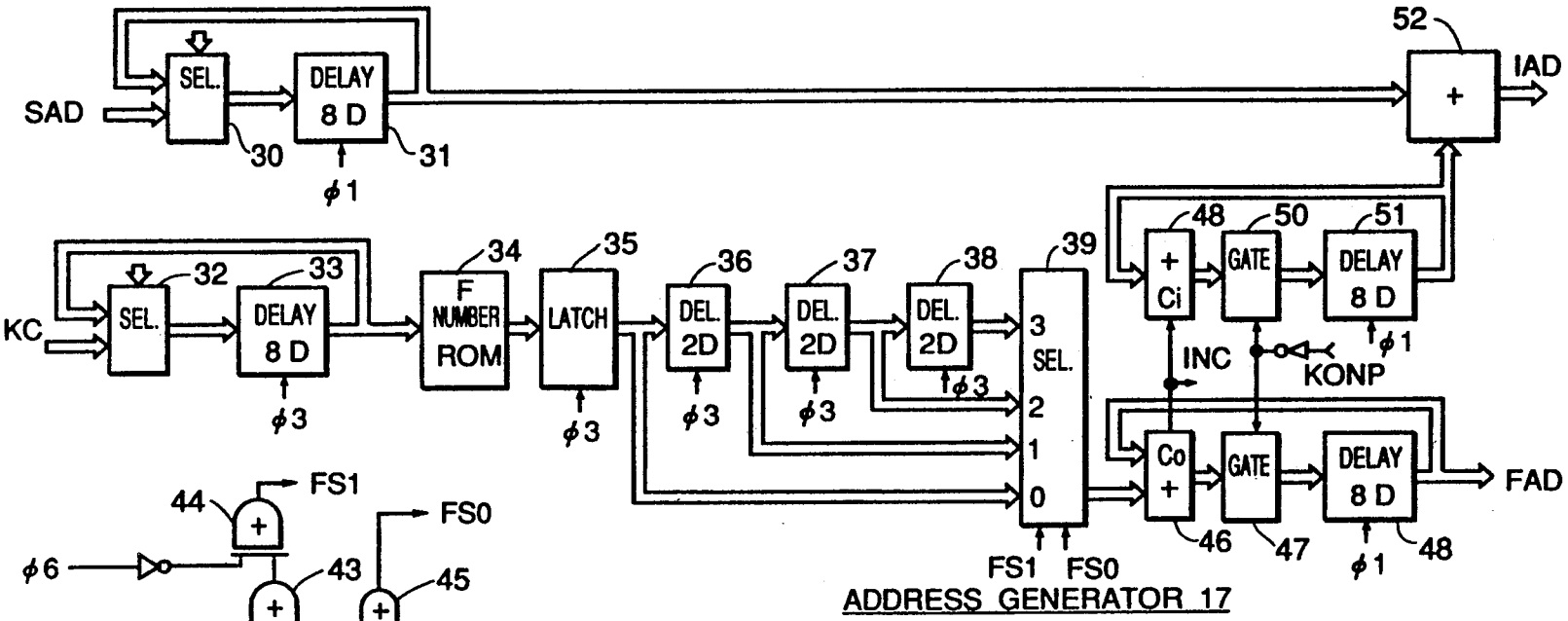
FIG. 4 is a block diagram showing an example of an address generator in FIG. 2.

In FIG. 4, a selector 30 and an 8-stage delay circuit 31 constitute a start address register. Start address data SAD designates a start address of a desired tone waveform stored in the waveform memory 18 and is provided through the I/O interface 15 in correspondence to a tone color of a tone assigned to each channel (it may be also provided in correspondence to a tone pitch). When start address data SAD for a certain channel is to be loaded, the selector 30 selects loading of the start address data SAD at a time division timing of the particular channel and causes this start address data SAD to be loaded in the delay circuit 31. At other times, the selector 30 selects circulation of the output of the delay circuit 31 to its input side and thereby causes the loaded data to be circulatingly held in a channel time division manner. The delay circuit 31 is delay controlled by the clock pulse $\phi 1$. The channel time division timing for reading out tone waveform sample data from the waveform memory 18 is established by this clock pulse $\phi 1$. In the part of "waveform sample CH" in FIG. 3, time division reading timing of tone waveform sample data of each channel is shown, and 0–7 indicate channel numbers.

A selector 32 and an 8-stage delay circuit 33 constitute a key code register. A key code KC is a code signal representing a key which has been assigned to each channel and is provided through the I/O interface 15. When a key code KC for a certain channel is to be loaded, the selector 32 selects loading of the key code KC at a time division timing of the particular channel and thereby causes the key code KC to be loaded in the delay circuit 33. At other times, the selector 32 selects circulation of the output of the delay circuit 33 to its input side and causes the loaded data to be circulatingly held in a channel time division manner. The delay circuit 33 is delay controlled by the clock pulse $\phi 3$.

The key code provided by the delay circuit 33 is converted to an F number by an F number ROM 34. The F number is a constant proportional to the tone pitch frequency. The key code KC may be expressed, for example, in a logarithmic form of F number and, in that case, the F number ROM 34 may be constructed as an exponential conversion ROM so that an F number in linear expression will be obtained. The F number provided by the ROM 34 is sequentially applied to three serially connected two-stage delay circuits 36, 37 and 38 through a latch 35. These delay circuits 36, 37 and 38 are delay controlled by the clock pulse $\phi 3$. Outputs of the latch 35 and the delay circuits 36, 37 and 38 are applied to inputs 0–3 of a selector 39, respectively.

Figure 5:
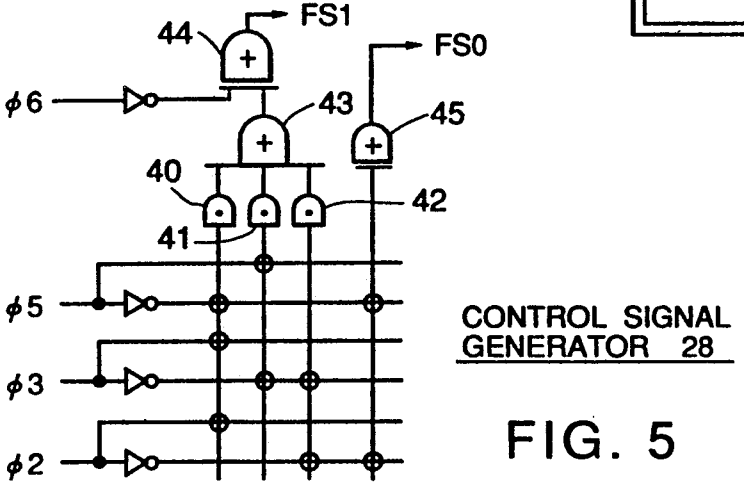
FIG. 5 is a block diagram showing an example of a control signal generator in FIG. 2.

To a selection control input of the selector 39 are applied 2-bit selection control signals FS0 and FS1 from a control signal generator 28 an example of which is shown in FIG. 5, and one of inputs 0–3 of the selector 39 is selected in accordance with a value of the control signals FS0 and FS1. In the control signal generator 28, the clock pulses $\phi 2$, $\phi 3$, $\phi 5$ and $\phi 6$ are processed by a logic circuit consisting of a combination of AND gates 40, 41 and 42, an OR gate 43 and exclusive OR gates 44 and 45 as shown in FIG. 5 to produce the selection control signals FS0 and FS1. The selection control logic is as shown in FIG. 5. By way of example, a logic table in a case where $\phi 6$ is 0 and $\phi 5$ is 0 is shown in Table 1 below.

TABLE 1

| input | | when $\phi 6 = 0, \phi 5 = 0$ output | | selection of |
|---|---|---|---|---|
| $\phi 3$ | $\phi 2$ | FS1 | FS0 | selector 39 |
| 0 | 0 | 0 | 0 | 0 |
| 0 | 1 | 1 | 1 | 3 |
| 1 | 0 | 1 | 0 | 2 |

TABLE 1-continued

| input | | when $\phi 6 = 0, \phi 5 = 0$ output | | selection of |
|---|---|---|---|---|
| $\phi 3$ | $\phi 2$ | FS1 | FS0 | selector 39 |
| 1 | 1 | 0 | 1 | 1 |

The purpose of providing the circuit consisting of the latch 35, delay circuits 36, 37 and 38 and selector 39 is to convert the channel time division timing of the output of the F number ROM 34 which follows the clock pulse $\phi 3$ to the channel time division timing shown in the part of "waveform sample CH" in FIG. 3 and thereby causes the channel time division timing of the F number to synchronize with the channel time division timing of the start address data SAD provided by the delay circuit 31.

The output of the selector 39 is applied to an adder 46. The circuit consisting of the adder 46, a gate 47 and an 8-stage delay circuit 48 constitutes an address decimal section counter which repeatedly adds, channel by channel, the F number of individual channels provided by the selector 39. The delay circuit 48 is delay controlled by the clock pulse $\phi 1$ and its output is applied to the adder 46. The F number has a magnitude which is below the decimal point of an address signal for waveform reading. By repeatedly adding this F number, a carry signal is produced from the adder 46 and this signal corresponds to an integer 1 of the address signal. This signal is provided as an address increment signal INC. The output of the delay circuit 48 is provided as a decimal section FAD of the address signal. The channel time division timing of the decimal section FAD of this address signal is as shown in "waveform sample CH" in FIG. 3.

The circuit consisting of an adder 49, a gate 50 and an 8-stage delay circuit 51 constitutes an address integer section counter which adds the address increment signal INC channel by channel. The delay circuit 51 is delay controlled by the clock pulse $\phi 1$ and its output is applied to the adder 49. The output of the delay circuit 51 is applied also to the adder 52 and added to the start address data from the delay circuit 31. The output of the adder 52 is address-input to the waveform memory 18 as the integer section IAD of the address signal. The channel time division timing of this integer section IAD of the address signal is also as shown in "waveform sample CH" of FIG. 3. The value of this integer section IAD of the address signal increments by 1 when the address increment signal INC has been generated with respect to the corresponding channel. The gates 47 and 50 are cleared at the start of sounding of a tone by a key-on pulse KONP.

From the waveform memory 18 of FIG. 2, therefore, tone signal sample data of each channel is read out on a time shared basis at a channel time division timing as shown in "waveform sample CH" of FIG. 3.

Tone signal sample data TSD of each channel which has been read from the waveform memory 18 on a time shared basis is applied to the interpolation filter 19. An example of the interpolation filter 19 will be described with reference to FIG. 6. Tone signal sample data TSD of respective channels provided on a time shared basis are applied to four latches 53A–53D. To load control inputs L of the latches 53A–53D are applied control signals La, Lb, Lc and Ld and to output control inputs S are applied control signals $\phi y$. These control signals La, Lb, Lc, Ld and $\phi y$ are generated by the control signal generator 27.

Figure 7:
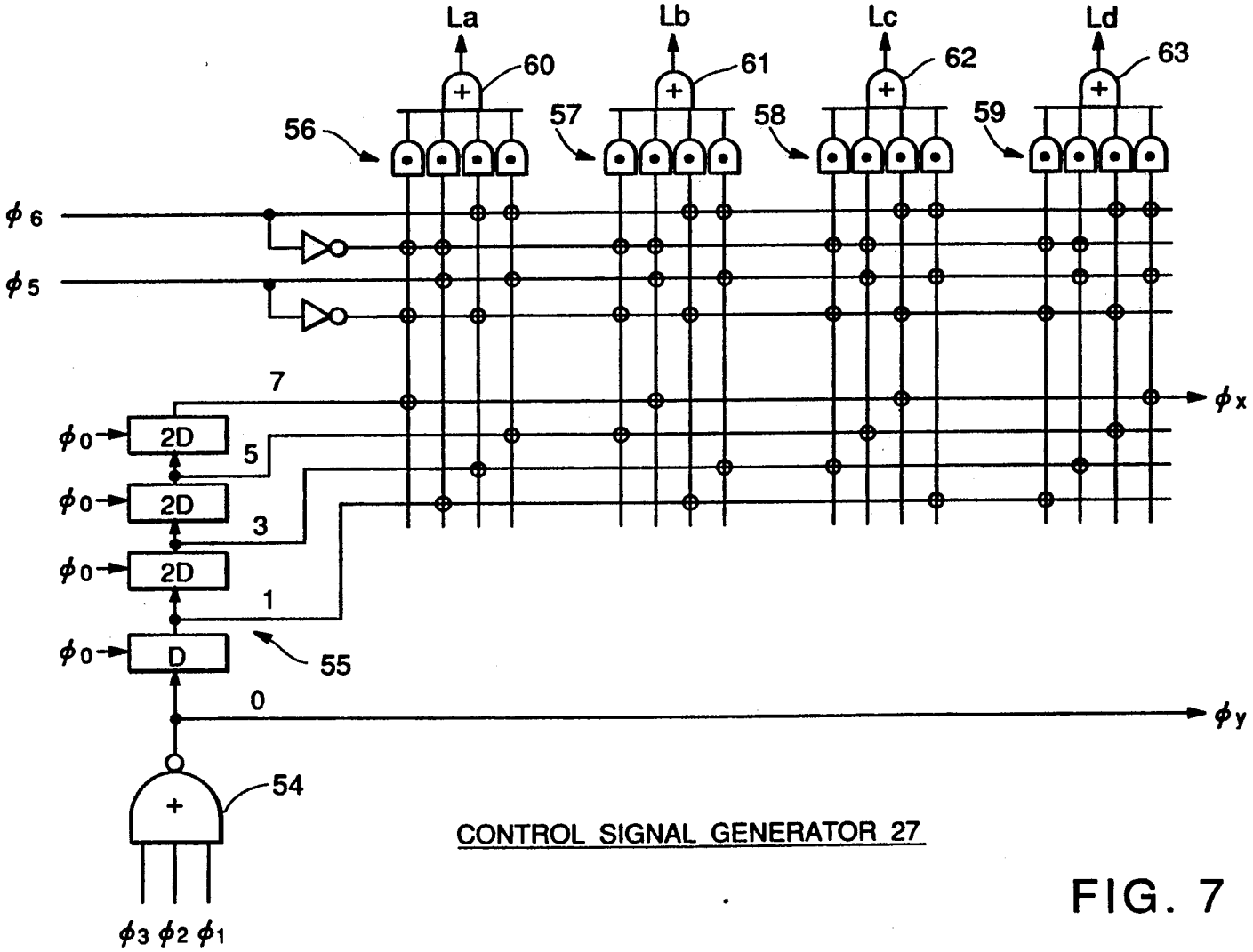
FIG. 7 is a block diagram showing an example of another control signal generator in FIG. 2.

An example of the control signal generator 27 is shown in FIG. 7. A NOR gate 54 receives the clock pulses $\phi 1$, $\phi 2$ and $\phi 3$ and outputs a signal "1" as the control signal $\phi y$ at a timing as shown in FIG. 3. Eight time division operation time slots 0–7 for n=8 coefficients per one channel are determined as shown in the part of "operation TM" of FIG. 3 starting with this control signal $\phi y$ and at a period of the clock pulse $\phi 0$. The control signal $\phi y$ is sequentially delayed by a delay circuit train 55 in response to the clock pulse $\phi 0$, and signals "1" which are produced from the delay circuit train 55 at timings of time slots 1, 3, 5 and 7 (TM1, TM3, TM5 and TM7) in the "operation TM" of FIG. 3 are applied to AND gates groups 56–59 as shown in FIG. 7. To the AND gate groups 56–59 are also applied clock pulses $\phi 5$ and $\phi 6$ and their inverted signals as shown in FIG. 7. The outputs of the respective AND gate groups are applied to OR gates 60–63 as shown in FIG. 7 and outputs of the OR gates 60–63 are provided as the control signals La, Lb, Lc and Ld. A signal "1" produced from the final stage of the delay circuit train 55 at a timing of time slot 7 (TM7) is provided as the control signal $\phi x$.

In FIG. 7, after all, the control signals La, Lb, Lc and Ld become "1" in response to the values of the clock pulses $\phi 6$ and $\phi 5$ and at respective operation time slots TM1, TM3, TM5 and TM7 in accordance with the logic of the following Table 2:

TABLE 2

| clock | | operation time slot (TM) | | | | | | | |
|---|---|---|---|---|---|---|---|---|---|
| $\phi 6$ | $\phi 5$ | 0 | 1 | 2 | 3 | 4 | 5 | 6 | 7 |
| 0 | 0 | | Ld | | Lc | | Lb | | La |
| 0 | 1 | | La | | Ld | | Lc | | Lb |
| 1 | 0 | | Lb | | La | | Ld | | Lc |
| 1 | 1 | | Lc | | Lb | | La | | Ld |

States of the latch loading control signals La, Lb, Lc and Ld are schematically shown in the part of La–Ld in FIG. 3.

Figure 6:
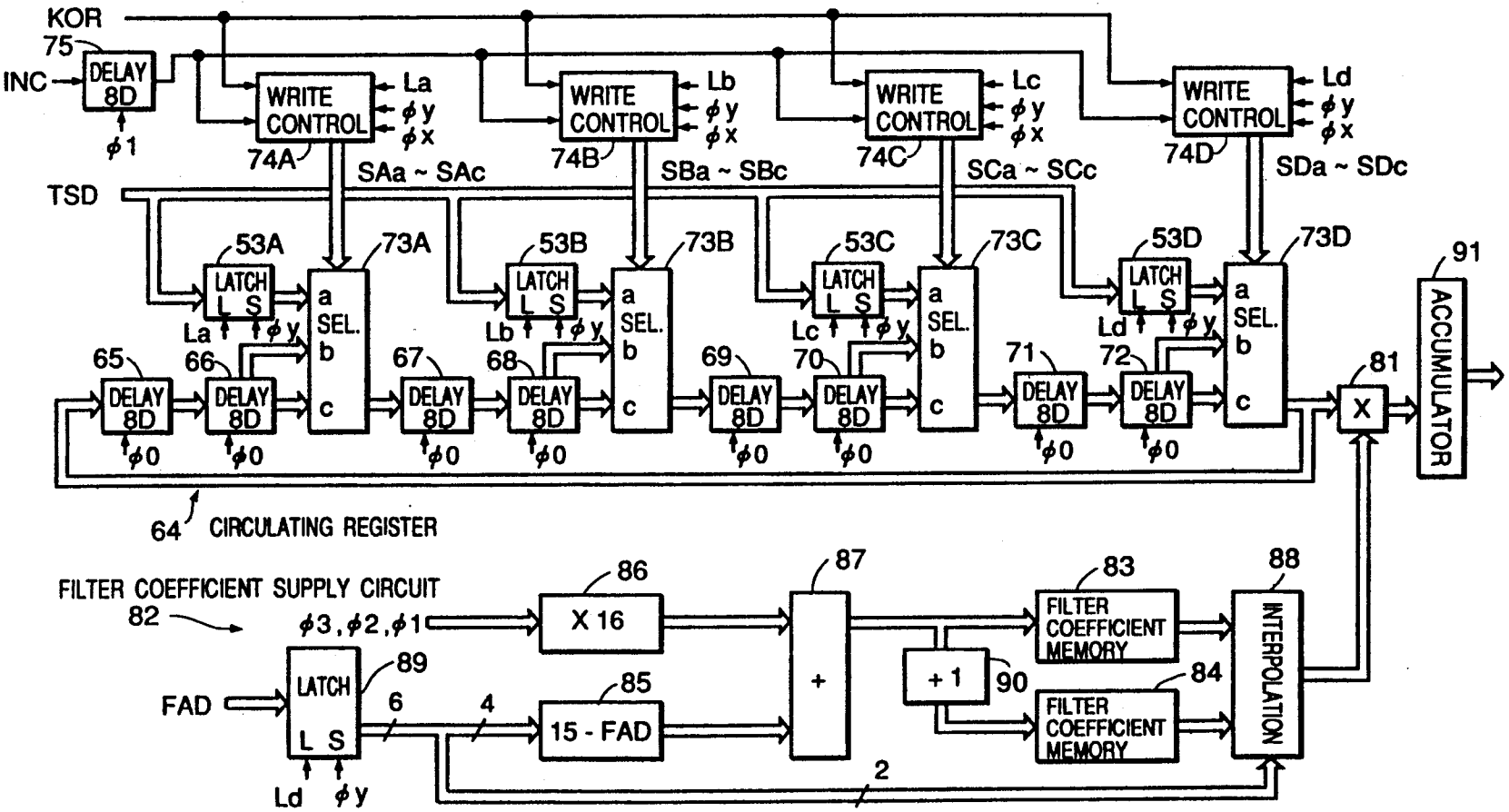
FIG. 6 is a block diagram showing an example of an interpolation filter.

In the latches 53A–53D in FIG. 6, therefore, tone signal sample data TSD of each channel is loaded in response to these control signals La, Lb, Lc and Ld (the channel time division timing is as shown in "waveform sample CH" in FIG. 3) and is delivered out at a timing corresponding to the latch output control signal $\phi y$. As will be apparent from comparison between the part of "waveform sample CH" and the part of "La–Ld" in FIG. 3, when, for example, $\phi 6$ and $\phi 5$ are both "0", waveform sample data of channel 0 is latched in the latch 53D, waveform sample data of channel 2 in the latch 53C, waveform sample data of channel 4 in the latch 53B, and waveform sample data of channel 6 in the latch 53A respectively, and these waveform sample data are delivered out during next 8 time slots at the timing of the control signal $\phi y$. Then, waveform sample data of channel 1 is latched in the latch 53D, waveform sample data of channel 3 in the latch 53C, waveform sample data of channel 5 in the latch 53B and waveform sample data of channel 7 in the latch 53A respectively and these waveform sample data are delivered out during next 8 time slots at the timing of the control signal $\phi y$. In this manner, in 2 cycles of the 8 time slot period, waveform sample data of each channel is latched by any of the latches 53A–53D and delivered out during 8 time slots. And, as the combination values of the clock pulses $\phi 6$ and $\phi 5$, change the channels of data loaded in the respective latches 53A–53D are sequentially shifted.

In FIG. 6, a circulating register 64 hold 8 tone signal sample data of each channel and includes a series of delay circuits 65–72 which hold respective sample data while delaying them sequentially. Each of the delay circuits 65–72 is of an 8-stage and delay controlled by the clock pulse $\phi 0$. These series of delay circuits 65–72 are connected in an endless manner and constitute a circulating loop. Four data selectors 73A–73D are in the series, one selector for every 16 delay stages interposed. For enabling each of the data selectors 73A–73D to perform a selection control as to whether new tone signal sample data is to be loaded in the delay circuit loop or data in the delay circuit loop is to be circulated, write control logics 74A–74D are provided.

The data selectors 73A–73D have three inputs a, b and c. To the a inputs are applied outputs of the latches 53A–53D. To the b inputs are applied delay outputs of the 7th stages of the delay circuits 66, 68, 70 and 72. To the c inputs are applied delay outputs of the 8-th stage of the delay circuits 66, 68, 70 and 72.

The write control logics 74A–74D receive a key-on reset signal KOR, the address increment signal INC and the control signals La–Ld, $\phi x$ and $\phi y$ and generate selection control signals SAa–SAc, SBa–SBc, SCa–SCc and SDa–SDc in response to these control signals, applying these selection control signals to corresponding data selectors 73A–73D.

The key-on reset signal KOR is a signal which becomes "0" instantaneously upon start of depression of a key assigned to each channel and is given in a time-division multiplexed state at a timing of a channel time division timing as shown in "waveform sample CH" in FIG. 3. The address increment signal INC is provided on the basis of a carry output of the adder 46 of FIG. 4 as described above. For enabling this signal INC to synchronize with time delay of 8 stages in the delay circuits 48 and 51, the signal INC which has been delayed likewise in the delay circuit 75 is applied to the write control logics 74A–74D. Since the value of the tone signal sample data changes when the address increment signal INC has been generated, by controlling loading of new tone signal sample data in response to this address increment signal INC, new tone signal sample data is loaded when the value of the tone signal sample data has been changed.

Figure 8:
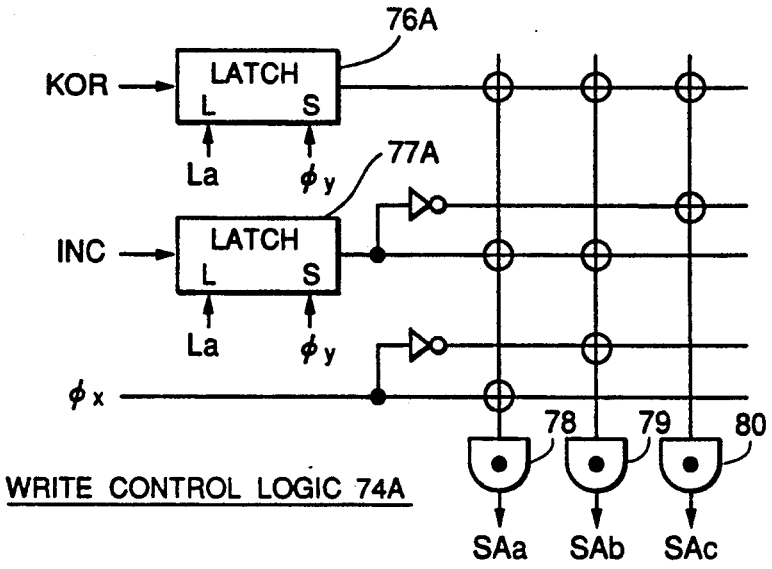
FIG. 8 is a block diagram showing an example of a write control logic in FIG. 6.

As a representative example of the write control logics 74A–74D, an example of the write control logic 74A is shown in FIG. 8. The key-on reset signal KOR is applied to a latch 76A and the address increment signal INC is applied to a latch 77A. As the latch 53A in FIG. 6, the latches 76A and 77A are load controlled by the control signal $\phi y$. Accordingly, the key-on reset signal KOR and the address increment signal INC which are of the same channel as those latched in the latch 53A are latched in the latches 76A and 77A. In synchronization with the 8-time slot period during which tone signal sample data of the particular channel is continuously provided from the latch 53A, output levels of the key-on reset signal KOR and address increment signal INC of the same channel are provided from the latches 76A and 77A. In other words, the latch 76A produces "0" during 8 time slots, when the key-on reset signal KOR has become "0" instantaneously upon start of depression of a key and produces "1" during other periods of time. The latch 77A produces "1" during 8 time slots, when the address increment signal INC has become "1", i.e., when the integer section of the address signal has increased by 1 and produces "0" during other periods of time.

The output of the latch 76A is applied to AND gates 78–80. The output of the latch 77A is applied to the AND gates 78 and 79 and its inverted signal is applied to the AND gate 80. The control signal $\phi x$ is applied to the AND gate 78 and its inverted signal is applied to the AND gate 79. Outputs of the respective AND gates 78–80 are supplied to the data selector 73A as the selection control signals SAa–SAc.

The selection control signal SAa provided from the AND gate 78 selects the a input in the data selector 73A in FIG. 6, thereby ordering loading of tone waveform sample data supplied from the latch 53A to the a input into the loop of the circulating register 64. The output of the data selector 73A is applied to the delay circuit 67 in the circulating register 64.

The selection control signal SAb provided from the AND gate 79 selects the b input in the data selector 73*a* thereby ordering application of the delay output of the 7th stage of the delay circuit 66 to the delay circuit 67.

The selection control signal SAc provided from the AND gate 80 selects the c input in the data selector 73A ordering application of the delay output of the 8-th stage of the delay circuit 66 to the delay circuit 67.

When, therefore, the address increment signal INC has become "1", i.e., tone waveform sample data has changed, the output of the latch 77A becomes "1" during time slots 0–7 (see the part of "operation TM" in FIG. 3), and during time slots 0–6 during which the control signal $\phi x$ is "0", the AND gate 79 is enabled so that the selection control signal SAb is turned to "1". But, at time slot 7, the control signal $\phi x$ turns to "1" so that the AND gate 78 is enabled and the selection control signal SAa becomes "1".

At time slot 0, data of the oldest sample point in the corresponding channel is provided from the 8th stage of the delay circuit 66. Since the output of the 7th stage is selected by the selection control signal SAb which is "1" through the b input, the data of the oldest sample point is cleared. Instead, next oldest data is applied to the delay circuit 67 and this data becomes the oldest data. In this manner, by selecting the output of the 7th output of the delay circuit 66 by the selection control signal SAb which is "1" through the b input during time slots 0–6, the order of sample data which circulates in the circulating register 64 is shifted.

When the selection control signal SAa has become "1" at the last time slot 7, new sample data in the corresponding channel which is latched in the latch 53A is loaded through the a input. Thus, newest 8 sample data in the particular channel are loaded in the circulating register 64 to be lined up in the order of oldness. The loaded data is sequentially delayed (shifted) in response to the clock pulse $\phi 0$.

When the address increment signal INC is "0", the output of the latch 77A is "0" and the AND gate 80 is enabled during all time slots 0–7 of the corresponding channel so that the selection control signal SAc becomes "1". The output of the 8th stage of the delay circuit 66 is thereby applied to the delay circuit 67 and 8 sample data arranged in the order of oldness circulate in this form. Thus, newest 8 sample data in the corresponding channel arranged in the order of oldness are held circulatingly in the circulating register 64.

When sounding of a new tone is to be started in the corresponding channel, the output of the latch 76A becomes "0" during all time slots 0–7 and all AND gates 78–80 are disabled. The selection control signals SAa–SAc all become "0" whereby circulation of 8 sample data of the corresponding channel is prohibited and storage thereof is cleared.

The other write control logics 74B–74D are of a similar construction as the write control logic 74A shown in FIG. 8. That is, they have similar latches 76B–76D and 77B–77D (not shown) to latch the key-on reset signal KOR and the address increment signal INC. However, different write control signals are used for the latches 76B–76D and 77B–77D. The latches 76B–76D and 77B–77D of the write control logics 74B–74D are controlled, in the same manner as the latches 53B–53D in FIG. 6, in loading by different control signals Lb–Lc and controlled in outputting by the control signal $\phi y$. Accordingly, the key-on reset signal KOR and the address increment signal INC of the same channel as the channel of tone waveform sample data latched in the latches 53B–53D are latched in the latches 76B–76D and 77B and 77D.

The respective write control logics 74B–74D provide the selection control signals SBa–SBc, SCa–SCc and SDa–SDc in accordance with state of output of the latches 76B–76D and 77B–77D by a logic which is similar to the AND gates 78–80 of FIG. 8 and these selection control signals are applied to the data selectors 73B–73D.

In the four data selectors 73A–73D, renewal and circulating control of sample data about four different channels are performed in parallel during the same 8 time slots. The channel state of sample data which is circulatingly held in the circulating register 64 is synchronized with the processed channel in the data selectors 73A–73D. The channel state of sample data circulatingly held in the circulating register 64 is as follows.

When, for example, the clock pulses $\phi 6$ and $\phi 5$ are both "0", as described above, waveform sample data of channel 0 is latched in the latch 53D, waveform sample data of channel 2 in the latch 53C, waveform sample data of channel 4 in the latch 53B and waveform sample data of channel 6 in the latch 53A respectively during first 8 time slots and these sample data are delivered out of these latches 53A–53D during next 8 time slots. Channels processed in the write control logics 74A–74D correspond to the above. Therefore, during these 8 time slots, 8 sample data provided by the selector 73A is data of channel 6, 8 sample data provided by the selector 73B is data of channel 4, 8 sample data provided by the selector 73C is data of channel 2 and 8 sample data provided by the selector 73D is data of channel 0.

During the latter 8 time slots when the clock pulses $\phi 6$ and $\phi 5$ are both "0", as described above, waveform sample data of channel 1 is loaded in the latch 53D, waveform sample data of channel 3 in the latch 53C, waveform sample data of channel 5 in the latch 53B and waveform sample data of channel 7 in the latch 53A and these waveform sample data are delivered out of the latches 53A–53D during next 8 time slots. Accordingly, during these 8 time slots, 8 sample data provided by the selector 73A is data of channel 7, 8 sample data provided by the selector 73B is data of channel 5, sample data provided by the selector 73C is data of channel 3 and sample data provided by the selector 73D is data of channel 1.

The output of the data selector 73D is supplied to a multiplier 81 as the output of the circulating register 64. As will be apparent from the foregoing description, the channel state of the output of the data selector 73D is as shown in the part of "operation CH" in FIG. 3. The state of operation time slots in each channel is as shown in "operation TM" in FIG. 3. There are 8 operation time slots 0–7 in one time slot of the channel shown in "operation CH" in FIG. 3 and newest 8 sample data for the corresponding channel are produced and circulate in the order of oldness. In other words, in the loop of 8-stage delay circuits 65–72, sample data of 8 channels×8 samples constantly circulate and these sample data are sequentially output on a time shared basis in the channel state shown in "operation CH" in FIG. 3.

Loading of new sample data by the data selectors 73A–73D is carried out consistently in correspondence to the channel of sample data which is circulating in the loop of the delay circuits 65–72. This is achieved by properly shifting generation of the control signals La–Ld determining the loading timing of the respective latches as shown in FIG. 3. Channel states of sample data provided by the delay circuits 65–72 during 8 time slots determined by combination of the clock pulses $\phi 6$, $\phi 5$ and $\phi 4$ are as shown in the following Table 3. Channel states of sample data which are newly loaded by the respective data selectors 73A–73D coincide, as shown in columns A, B, C and D in Table 3, with the channel of output data of the delay circuits 66, 68, 70 and 72. This is because sample data of each channel shown in the part of "waveform sample CH" are latched by the latches 53A–53D at timings of the control signals La–Ld by shifting generation of the control signals La–Ld sequentially.

TABLE 3

| | | | Channel state in the delay circuits 65–72 and data selectors A–D in the circulating register | | | | | | | |
|---|---|---|---|---|---|---|---|---|---|---|
| clock | | | | A | | B | | C | | D |
| $\phi 6$ | $\phi 5$ | $\phi 4$ | 65 | 66 | 67 | 68 | 69 | 70 | 71 | 72 |
| 0 | 0 | 0 | 6 | 5 | 4 | 3 | 2 | 1 | 0 | 7 |
| 0 | 0 | 1 | 7 | 6 | 5 | 4 | 3 | 2 | 1 | 0 |
| 0 | 1 | 0 | 0 | 7 | 6 | 5 | 4 | 3 | 2 | 1 |
| 0 | 1 | 1 | 1 | 0 | 7 | 6 | 5 | 4 | 3 | 2 |
| 1 | 0 | 0 | 2 | 1 | 0 | 7 | 6 | 5 | 4 | 3 |
| 1 | 0 | 1 | 3 | 2 | 1 | 0 | 7 | 6 | 5 | 4 |
| 1 | 1 | 0 | 4 | 3 | 2 | 1 | 0 | 7 | 6 | 5 |
| 1 | 1 | 1 | 5 | 4 | 3 | 2 | 1 | 0 | 7 | 6 |

In the embodiment of FIG. 6, the interpolation filter 19 consists of an FIR type digital filter and multiplies tone signal sample data provided by the circulating register 64 with filter coefficients in a multiplier 81. The filter coefficients are supplied from a filter coefficient supply circuit 82.

In this embodiment, the filter coefficient supply circuit 82 supplies filter coefficients of plural orders in accordance with a value of the decimal section FAD of the address signal and substantially carries out a filter operation of m orders by an omitted coefficient operation for n coefficients.

The n coefficients are operated with respect to different tone signal sample data of n samples and, therefore, different tone signal sample data of n samples are operated for interpolation in response to n coefficients and, as a result, one sample data is composed by interpolation.

The number n is determined based on a relationship $n=m/d$ in accordance with a number d which divides the decimal section FAD in the address signal. The n filter coefficients to be determined correspond to n orders which are spaced from each other sequentially at an interval of d. The n order numbers are respectively determined in accordance with the value of the decimal section FAD of a current address signal and n filter coefficients which correspond to the n order numbers thus determined in accordance with the decimal section FAD of the current address signal are supplied from the filter coefficient supply circuit 82. By this arrangement, in a convolution operation in an m-th filter where operation must be made with respect to coefficient data of all order number m, operation is made only with respect to coefficient data of $n=m/d$ and therefore, the scale of operation can be reduced to 1/d. Besides, assuming that sampling frequency in an actual operation is fs, a result which is equivalent to a result of digital filter operation with a high resolution of d·fs can be obtained. Description about the principle of carrying out substantially the filter operation of m orders with an omitted coefficient operation for n coefficients is given in detail in the above described Japanese Preliminary Patent Publication No. 63-168695 corresponding to U.S. Pat. Ser. No. 07/139,659, so that detailed description thereof is omitted.

Further, for improving accuracy of filter operation without excessively enlarging the scale of the circuit, the filter coefficient supply circuit 82 in this embodiment is so constructed that filter coefficients are generated densely by interpolation as will be described below. More specifically, for performing filter operation of orders of q times m, i.e., filter operation of q·m orders using filter coefficients of m orders, interpolation with resolution q is made between adjacent filter coefficients of m orders and filter coefficients of q·m orders are densely generated. By such interpolation of q times, an equivalent sampling frequency in the digital filter operation becomes a high resolution frequency q·d·fs and the filter order number becomes q·m, so that accuracy of filter operation can be remarkably improved.

Referring to FIG. 6, the filter coefficient supply circuit 82 will be described. In the embodiment of FIG. 6, the dividing number d of the decimal section FAD of the address signal is determined as $d=16$ and the filter order number is determined as $m=128$ and $n=8$. Further, an interpolation with resolution $q=4$ is made between adjacent ones of filter coefficients of m orders whereby filter coefficients of q·m orders=512 orders are densely generated. The decimal section FAD of the address signal therefore consists basically of 4-bit data corresponding to the dividing number $d=16=2^4$, and lower order 2 bits are added thereto to designate an interpolation step with resolution $q=4$. In the present embodiment, therefore, the decimal section FAD of the address signal consists of data of 6 bits. Further, as will be apparent from the above description, the sampling frequency is fixedly determined in correspondence to the channel time division frequency and a tone signal therefore is generated with a sampling frequency which is not synchronous with pitch. Since, in this embodiment, the digital filter is constructed of an FIR filter of low-pass filter characteristics, a waveform interpolation operation function in which a tone waveform can be generated smoothly is realized and, besides, removal of an aliasing noise can be achieved. It is of course possible to perform a tone color control by suitably determining the filter coefficients.

The filter coefficient supply circuit 82 includes filter coefficient memories 83 and 84 which respectively store filter coefficients of m=128 orders (0th to 127th order), selection means (subtractor 85, multiplier 86 and adder 87) for selecting filter coefficients of n=8 from among these filter coefficients of 128 orders in accordance with the value of the decimal section FAD of the address signal, and an interpolation circuit 88. Two filter coefficient memories are of the same construction and are provided separately for reading out two adjacent filter coefficients in parallel for interpolation in the interpolation circuit 88. Impulse response of filter coefficients stores in these filter coefficient memories 83 and 84 may be any desired one representing a desired tone color control characteristic or noise elimination characteristic or waveform interpolation characteristic. A combination of filter coefficients may be selected in response to tone color information or other information.

The channel time division state of the decimal section FAD of the address signal provided by the delay circuit 48 of FIG. 4 is as shown in "waveform sample CH" in FIG. 3 and this decimal section FAD is applied to a latch 89. In the latch 89, as in the latch 53D, input data is loaded by the control signal Ld and is delivered out in synchronism with the control signal $\phi$y. Accordingly, as will be understood by referring to timings of "waveform sample CH" and "La-Ld" in FIG. 3, the decimal sections FAD of the address signal for channels 0, 1, 2, 3, . . . are sequentially latched and delivered out at the time division timing of "operation CH" in FIG. 3.

Upper 4 bits in the decimal section FAD of the address signal provided by the latch 89 are applied to the subtractor 85 and lower order 2 bits are applied to an interpolation circuit 88.

The subtractor 85 subtracts upper 4-bit data of the decimal section FAD of the address signal from decimal number 15 to obtain "15−FAD". A multiplier 86 receives 3-bit data consisting of the clock pulses $\phi$3, $\phi$2 and $\phi$1 and multiplies it with decimal number 16. The value of the 3-bit data consisting of $\phi$3, $\phi$2 and $\phi$1 represents a value corresponding to the operation time slots 0–7 (see "operation TM"). To multiply this by 16 means to output 0, 16, 32, 48, 64, 80, 96 and 112 at each operation time slots 0–7. The output of the subtractor 85 and the output of the multiplier 86 are added together by an adder 87 to provide 15−FAD, FAD+1, FAD+17, FAD+33, FAD+49, FAD+65, FAD+81 and FAD+97 at each operation time slots 0–7.

The output of the adder 87 represents the order number of filter coefficient concerning tone waveform sample data of n=8 sample points at each operation time slot. The order number jumps by 16 at each sample point and changes in accordance with the value of the decimal section FAD of the address signal.

The output of the adder 87 is applied directly to the filter coefficient memory 83, and it is also applied to the filter coefficient memory 84 after 1 having been added thereto by an adder 90. In this manner, two filter coefficient data of adjacent order numbers are read from the filter coefficient memories 83 and 84. These two filter coefficient data are supplied to an interpolation circuit 88 where they are interpolated with a 4-step interpolation characteristic (e.g., linear interpolation characteristic) in response to lower 2-bit data of the decimal section FAD of the address signal. Thus, filter coefficients of m=128 orders are actually stored in the memories 83 and 84 but the effect of densely having filter coefficients of q·m=4×128=512 orders can be obtained by such interpolation. The output of the interpolation circuit 88 is applied to the multiplier 81.

In the multiplier 81, 8 sample data are multiplied with filter coefficients of predetermined order number at operation time slots 0–7 for one channel. These 8 products for one channel are accumulated by an accumulator 91 to obtain a convolution sum. From this accumulator 91 is output a result of filter operation for each channel in the channel time division state shown in "operation CH" in FIG. 3 and this result is supplied as the output of the interpolation circuit 19 to the multiplier 20 (FIG. 2) for envelope multiplication.

In the above described embodiment, the filter coefficient supply circuit 82 supplies filter coefficients of 512 orders by interpolating filter coefficients of m=128 orders. Such interpolation of coefficients, however, may be omitted.

The filter coefficient supply circuit 82 supplies filter coefficients of a larger number (e.g., m=128) than the number of operation time slots n=8 and thereby performs an accurate filter operation with a simple operation. The invention however is not limited to this but the filter operation may be performed by using operation time slots which are of the same number as the filter order number employed.

According to another embodiment, the circulating register 64 is replaced by a read/write memory such as a random-access memory (RAM).

Figure 9:
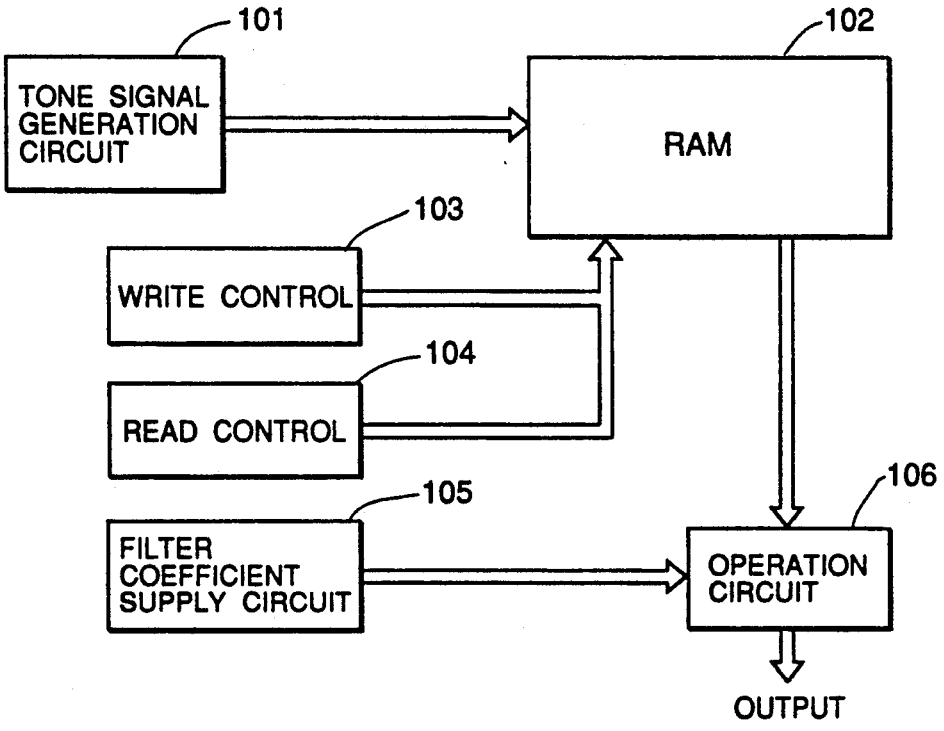
FIG. 9 is a block diagram showing another embodiment of the invention.

FIG. 9 shows an example of such another arrangement which includes a tone signal generation circuit 101 for generating tone signal sample data of plural channels at a first channel time division period on a time shared basis, a RAM 102 for storing plural tone signal sample data of each channel, a write control logic circuit 103 for writing tone signal sample data of each channel generated by the tone signal generation circuit 101 into the RAM 102, a read control logic circuit 104 for reading out plural tone signal sample data of each channel stored in the RAM 102 sequentially at a second channel time division period which is independent from the first channel time division period, a filter coefficient supply circuit 105 for supplying filter coefficient of plural orders, and an operation circuit 106 for operating tone signal sample data which has been sequentially read from the RAM 102 with the filter coefficients and thereby obtaining a filter operation output.

In this arrangement, tone signal sample data of each channel supplied at a first channel time division period such as "waveform sample CH" in FIG. 3 may be sequentially written at predetermined addresses of the RAM 102 and predetermined sample data may be sequentially read from the RAM 102 at a second channel time division period as shown in "operation CH" in FIG. 3 which is independent from the first channel time division period and at each of operation time slots 0–7 as shown in "operation TM" in FIG. 3.

As described above, according to the invention, by providing plural data selection circuits at predetermined delay stages in a delay circuit loop which circulatingly holds tone signal sample data of plural channels while delaying the data sequentially, new tone signal sample data can be loaded at plural points in the delay circuit loop whereby tone signal sample data of a necessary channel can be loaded in the delay circuit loop at a point of a necessary data selection circuit at a time period which is shorter than one cycle of the entire delay circuit loop. Therefore, the time division period of tone signal sample data of each channel supplied from the tone signal generation means can be made different from the time division period of each channel in the delay circuit loop whereby a sufficiently accurate tone signal sampling can be realized without imposing too much burden on the circuitry, that is, without requiring a time division operation at an excessively high rate.

What is claimed is:

1. A tone signal processing device comprising:

tone signal generation means for generating tone signal sample data of plural channels on a time shared basis;s circulating register means for holding plural tone signal sample data for each of said channels, said circulating register means comprising a series of delay circuits holding respective sample data while delaying the data sequentially, said series of delay circuits being connected in an endless manner to form a single circulating loop for holding sample data of plural channels and having plural data selection circuits at predetermined delay stages, and each of said data selection circuits performing a selection control as to whether or not new tone signal sample data generated by said tone signal generation means should be provided to said delay circuit loop;

filter coefficient supply means for supplying filter coefficients of plural orders; and operation means for performing operations between tone signal sample data which has been sequentially provided from said circulating register means after delay and said filter coefficients and thereby obtaining a filter operation output.

2. A tone signal processing device as defined in claim 1 wherein said tone signal generation means comprises means for generating an address signal consisting of an integer section and a decimal section whose values change at a rate corresponding to tone pitch of a tone to be generated and means for generating tone signal sample data for each channel on a time shared basis in response to the integer section of an address signal of each channel, and said filter coefficient supply means supplies the filter coefficients of plural orders in response to a value of the decimal section of the address signal.

3. A tone signal processing device as defined in claim 1 wherein said circulating register means supplies the new tone signal sample data to said delay circuit loop for each channel when a value of tone signal sample data in said channel changes, whereby different value sample data circulate in said delay circuit loop, said filter coefficient supply means generates a filter coefficient to achieve desired interpolation characteristics, and said operation means performs an interpolation operation by performing operations between different sample data and said filter coefficient.

4. A tone signal processing device as defined in claim 1 wherein said circulating register means loads tone signal sample data from said tone signal generation means to said delay circuit loop at a constant sampling period.

5. A tone signal processing device as defined in claim 1 wherein said tone signal generating means can generate plural sample data for each channel during a time of one circulation through the loop of said circulating register, and said data selection circuits pass said plural sample data to said loop so that values in said circulating register means are renewed by said plural sample data.

6. A tone signal processing device comprising:

tone signal generation means for generating tone signal sample data of plural channels at a first channel time division sampling rate on a time shared basis, wherein said tone signal generation means comprises means for generating an address signal consisting of an integer section and a decimal section whose values change at a rate corresponding to tone pitch of a tone to be generated and means for generating tone signal sample data for each channel on a time shared basis in response to the integer section of an address signal of each channel;

read/write memory means for storing plural samples of tone signal sample data of each channel;

write means for writing tone signal sample data of each channel generated by said tone signal generation means into said memory means;

read means for reading out plural tone signal sample data of each channel stored in said memory means sequentially at a second channel time division sampling rate which is independent from said first channel time division sample rate;

filter coefficient supply means for supplying filter coefficients of plural orders in response to a value of the decimal section of the address signal; and operation means for performing operations between tone signal sample data which has been sequentially read from said memory means and said filter coefficients and thereby obtaining a filter operation output.

7. A tone signal processing device comprising:

tone signal generation means for generating tone signal sample data of plural channels at a first channel time division sampling rate on a time shared basis;

read/write memory means for storing plural samples of tone signal sample data of each channel;

write means for writing tone signal sample data of each channel generated by said tone signal generation means into said memory means;

read means for reading out plural tone signal sample data of each channel stored in said memory means sequentially at a second channel time division sampling rate which is independent from said first channel time division sampling rate;

filter coefficient supply means for supplying filter coefficients of plural orders; and operation means for performing operations between tone signal sample data which has been sequentially read from said memory means and said filter coefficients and thereby obtaining a filter operation output, wherein said write means loads new tone signal sample data for each channel to said memory means when the value of tone signal sample data in said channel changes, whereby said memory means stores sample data of different values, said different value sample data are sequentially read by said read means, said filter coefficient supply means generates a filter coefficient to achieve desired interpolation characteristics, and said operation means performs an interpolation operation by performing operations between different value sample data and said filter coefficient.

8. A tone signal processing device for processing tone signals of n channels on a first time shared basis, comprising:

tone signal generation means for generating tone signal sample data for each of said n channels on a second time shared basis, said tone signal generation means comprising means for generating an address signal consisting of an integer section and a decimal section whose values change at a rate corresponding to tone pitch of a tone to be generated and means for generating tone signal sample data for each channel on the second time shared basis in response to the integer section of an address signal of each channel;

register means for storing m tone signal sample data for each of said n channels, and providing said m tone signal samples for each period of said n channels of the first time shared basis;

renewing means for renewing some of said m tone signal sample data stored by said register means each time said tone signal generation means generates new sample data of a certain channel, using said new sample data generated;

filter coefficient supply means for supplying filter coefficients of plural orders in response to a value of the decimal section of the address signal; and operation means for operating said m tone signal sample data provided from said register means with said filter coefficients and thereby obtaining a filter-operated output for each period of said n channels of the first time shared basis.

* * * * *